US005174361A

United States Patent [19]

Kursfeld

[11] Patent Number: 5,174,361

[45] Date of Patent: Dec. 29, 1992

[54] AUTOMATIC CASTING PROCESS OF A CONTINUOUS CASTING MACHINE

[75] Inventor: Armin Kursfeld, Unterägeri, Switzerland

[73] Assignee: Stopinc Aktiengesellschaft, Baar, Switzerland

[21] Appl. No.: 661,538

[22] Filed: Feb. 27, 1991

[30] Foreign Application Priority Data

Feb. 28, 1990 [CH] Switzerland ..... 622/90

[51] Int. Cl.[5] ..... B22D 11/08; B22D 11/18

[52] U.S. Cl. ..... 164/453; 164/449; 164/483

[58] Field of Search ..... 164/453, 483, 155, 449, 164/450

[56] References Cited

U.S. PATENT DOCUMENTS

| | | | |
|---|---|---|---|
| 4,770,230 | 9/1988 | Tinnes et al. | 164/483 |
| 4,771,821 | 9/1988 | Matsushita et al. | 164/453 X |
| 4,774,999 | 10/1988 | Kraus | 164/483 X |
| 4,787,437 | 11/1988 | Kursfeld | 164/483 X |

FOREIGN PATENT DOCUMENTS

| | | | |
|---|---|---|---|
| 2928901 | 1/1981 | Fed. Rep. of Germany | 164/449 |
| 3010811 | 9/1981 | Fed. Rep. of Germany | 164/483 |
| 3344127 | 6/1985 | Fed. Rep. of Germany | 164/453 |
| 3421344 | 12/1985 | Fed. Rep. of Germany | 164/449 |
| 56-68570 | 6/1981 | Japan | 164/483 |
| 63-21586 | 5/1988 | Japan | 164/453 |

*Primary Examiner*—J. Reed Batten, Jr.
*Attorney, Agent, or Firm*—Wenderoth, Lind & Ponack

[57] ABSTRACT

An automatic casting process of a continuous casting machine includes a mold filling mode and a continuous casting mode. The continuous casting machine includes a metallurgical vessel having a discharge opening, a stopper for opening and closing to an affective flow rate of a molten metal from the discharge opening, and a control device for controlling the opening and closing of the stopper. The mold filling mode of the automatic casting process entails repeatedly opening and closing the stopper to discharge the molten metal into a continuous casting mold having an extracting end sealed by a starting head. The opening and closing of the stopper during the mold filling mode is effected at predetermined time intervals and at predetermined stopper positions which are preprogrammed in the control device. The level of the molten metal within the continuous casting mold is monitored, and when the monitored level reaches a predetermined level, the mold filling mode is terminated, the starting head is withdrawn from the extracting end of the continuous casting mold, and the continuous casting mode of controlling the stopper position is initiated to maintain the predetermined level of the molten metal within the continuous casting mold.

19 Claims, 4 Drawing Sheets

AUTOMATIC CASTING PROCESS OF A CONTINUOUS CASTING MACHINE

BACKGROUND OF THE INVENTION

1. Field of the Invention

The present invention relates to an automatic casting process of a continuous casting machine in which a flow rate of molten metal discharged from a metallurgical vessel into a continuous casting mold is controlled using a stopper end provided in the metallurgical vessel. During an initial casting mold filling mode, the stopper is repeatedly opened and closed according to preprogrammed time intervals and preprogrammed stopper positions to thereby discharge the molten metal into the continuous casting mold having an extracting end thereof sealed by a starting head.

2. Description of the Related Art

Conventionally, when the continuous casting mold is initially filled with molten metal, the mold is continuously filled with the molten metal, and during a specific dwell time, the molten metal sets and binds with a starting head which seals an extracting end of the continuous casting mold.

Upon expiration of the specific dwell time, which is established based on experience, the starting head is removed without consideration as to whether the molten metal has set, and a continuous casting passage is thereby produced.

According to the aforementioned process (Regelungstechnische Praxis and Prozessrechnertechnik, Issue 2, 1969, p. 68), automatic casting is targeted in that the stopper is actuated to "open" and "shut" positions using a control system responsive to a predetermined timing program. As the level of the molten metal within the continuous casting mold reaches the beginning of the measuring range of a level indicator arranged in the upper region of the casting mold, a limit indicator switches off the open/shut control, and a process for regulating this discharge amount of the molten metal is initiated so as to maintain a constant predetermined level of molten metal within the casting mold. In practice, it has been demonstrated that automatic casting using a stopper as the molten metal flow control element is extremely difficult to carry out due to its regulating characteristics. The regulation of the molten metal discharge amount cannot be finely adjusted using the stopper, since the stopper defines only a relatively short stroke from closing to a fully open position.

SUMMARY OF THE INVENTION

An object of the present invention is to improve on the automatic casting process of the conventional apparatus using a stopper to control the molten metal discharge amount, such that a highly reliable casting process under specific conditions can be achieved.

The above object is achieved according to the present invention by repeatedly opening and closing the stopper to discharge the molten metal into the continuous casting mold during an initial filling of the continuous casting mold. The opening and closing of the stopper is effected at predetermined time intervals and at predetermined stopper positions.

According to the precise automatic casting process of the present invention, the conventional problems associated with the use of the stopper are not present, even during varying conditions and arrangements of the continuous casting machine.

In a preferred variation of the process of the present invention, the stopper is moved into an approximately fully opened position during the first, or during the first few, opening strokes and then the opened position is subsequently reduced for each stroke as the molten metal level within the casting mold rises.

When the level of the molten metal within the casting mold approaches a predetermined level, the position of the stopper for each stroke is made to correspond to an average stopper position during a regulated discharging of the molten metal while continuous casting is being carried out. Thus, there is a continuous transition from the initial filling of the casting mold to the actual continuous casting.

The open/shut movements of the stopper according to the process of the present invention are to be understood in the context that these movements entail completely opening or closing of the stopper or moving the stopper to a throttle position.

The effective closing position of the stopper varies, on the one hand, prior to each casting start due to the insertion of the discharge sleeve (or casting pipe) into the refractory vessel lining, and, on the other hand, experience has shown that following the first opening of the stopper when discharging, when the stopper is again closed, its position moves by a specific amount. According to the present invention, with each opening of the stopper, the closing position is measured, and the subsequent opening of the stopper is adapted according to the thus measured closing position. Accordingly, the accuracy of the casting process is enhanced.

It is further noted that the process of the present invention can be equally applied to stopper-like shut-offs.

BRIEF DESCRIPTION OF THE DRAWINGS

Other advantages and features of the present invention are explained in detail below with reference to the accompanying drawings, in which.

DETAILED DESCRIPTION OF THE PREFERRED EMBODIMENTS

Figure 1:
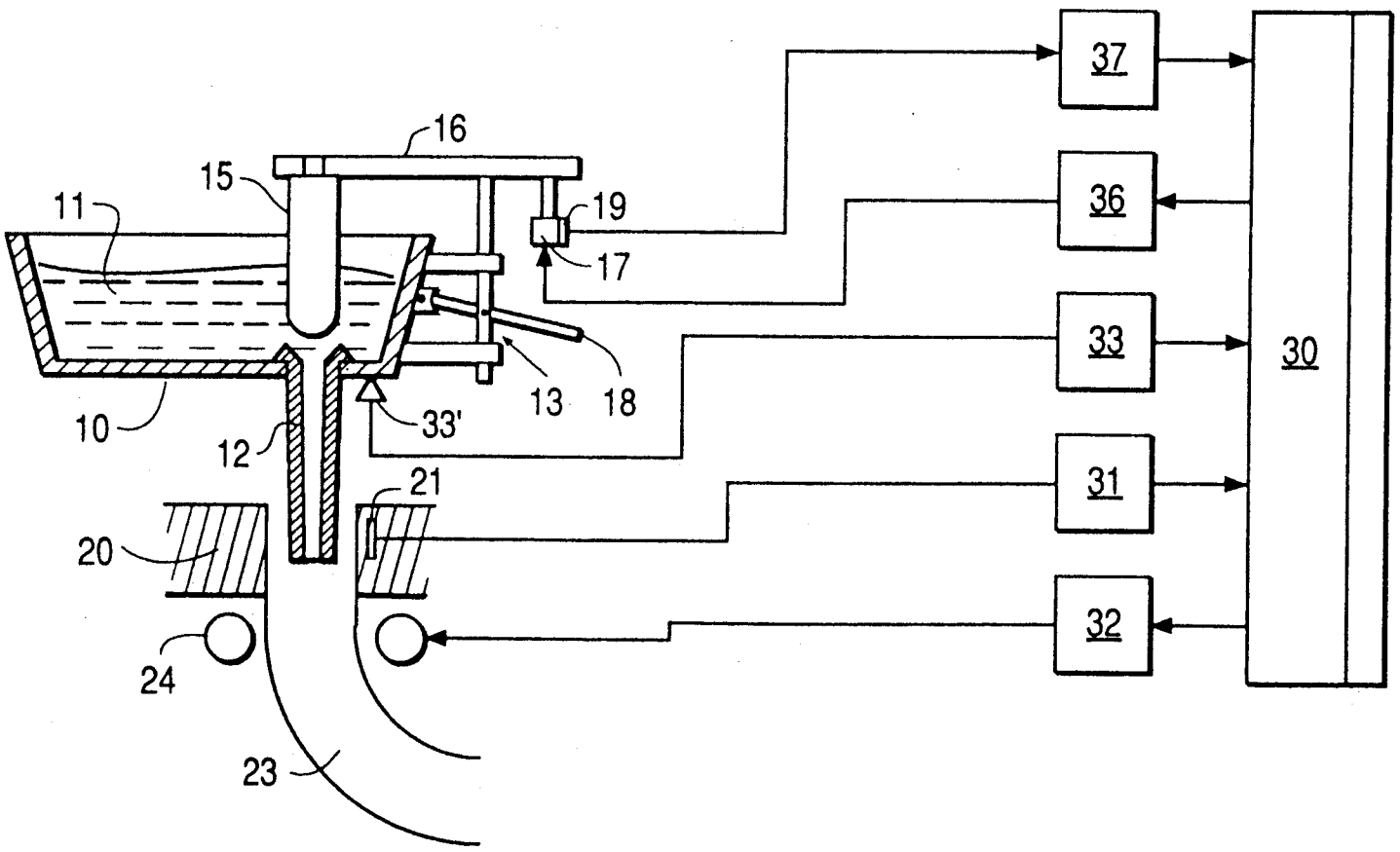
FIG. 1 depicts a schematic view of a continuous casting machine, together with a block diagram of the casting control apparatus.

FIG. 1 depicts a continuous casting machine which may be used according to the casting process of the present invention. Molten metal 11 flows from a metallurgical vessel 10 through a refractory casting pipe 12 arranged at a discharge opening of a mold 20. The vessel 10 is usually a tundish having a refractory lining and a steel shell. The flow rate of the molten metal may be controlled using the stopper end 15 located in the vessel 10, and during continuous casting, the stopper 15 is controlled to regulate the amount of molten metal discharged into the casting mold 20. The refractory stopper 15 is attached to a support arm 16 and can be vertically positioned using a toggle joint 18 at a rod 13. The stopper 15 can be vertically positioned manually, particularly in an emergency, and it can also be positioned by use of a drive element 17. A data transmitter 21, that usually operates on a radioactive basis, in the upper region of the mold 20 measures the level h of the molten metal within the mold 20 and outputs a corresponding signal to a level indicator 31, which in turn forwards a process signal to a computer 30. The strand 23 formed by the set molten metal is withdrawn using a drive 24 at an extraction speed v. The computer 30 initiates the drive 24 by means of a switch 32.

Additionally, a weight indicator 33 may also be provided to indirectly determine the amount of molten metal which is in the metallurgical vessel 10. A commercially available load cell 33' may be used as the weight indicator, to transmit a signal to the device 33, which in turn informs the computer 30 of the detected weight.

The automatic casting process according to the present invention is initiated after molten metal 11 has been filled into the vessel 10, either by manually operating a switch or automatically in response to the signal output by the weight indicator 33 to the computer 30 indicating that the molten metal 11 has reached a desired level.

Figure 2:
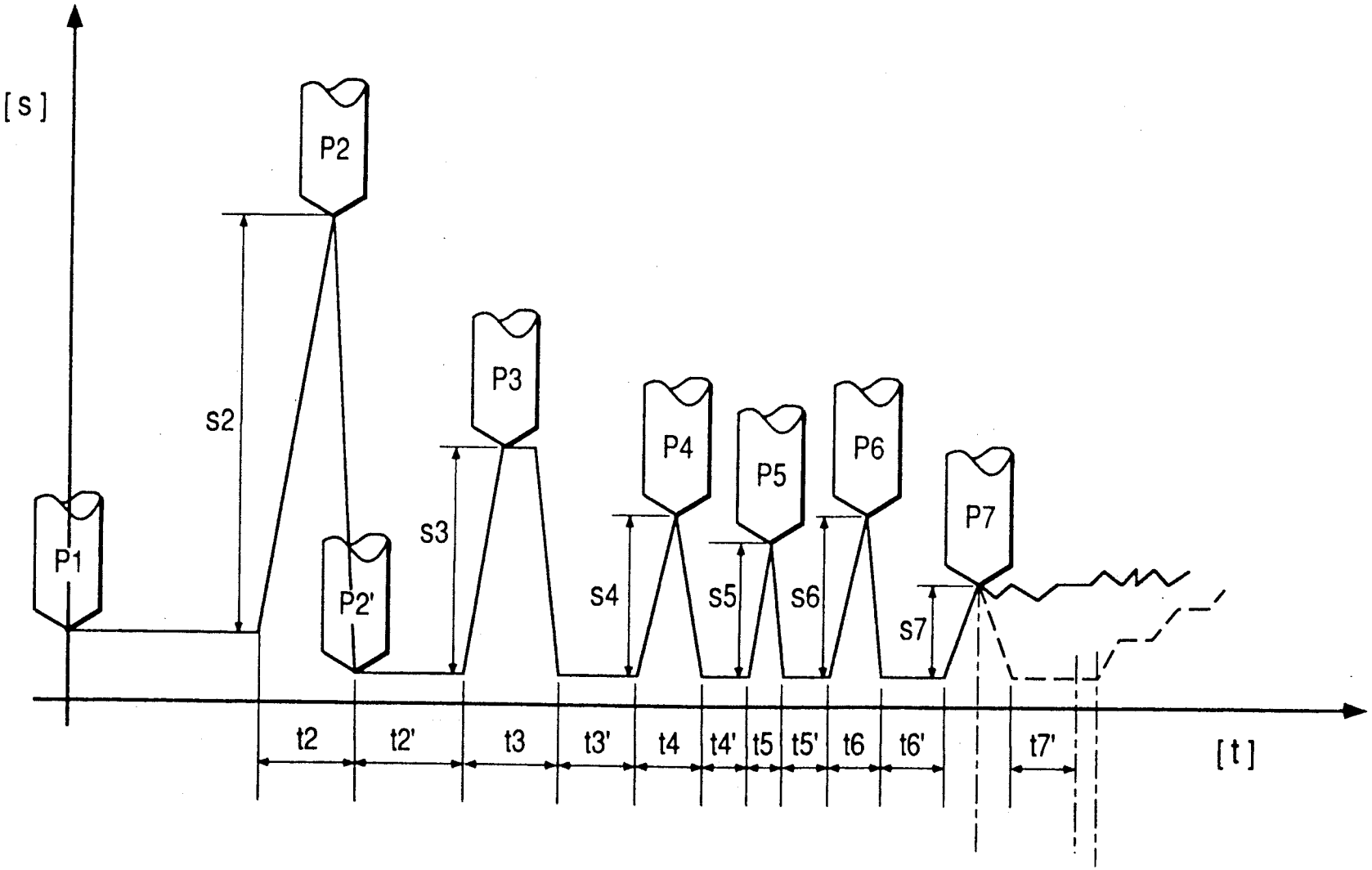
FIG. 2 depicts the stopper position with respect to time according to the casting process of the present invention.
Figure 3:
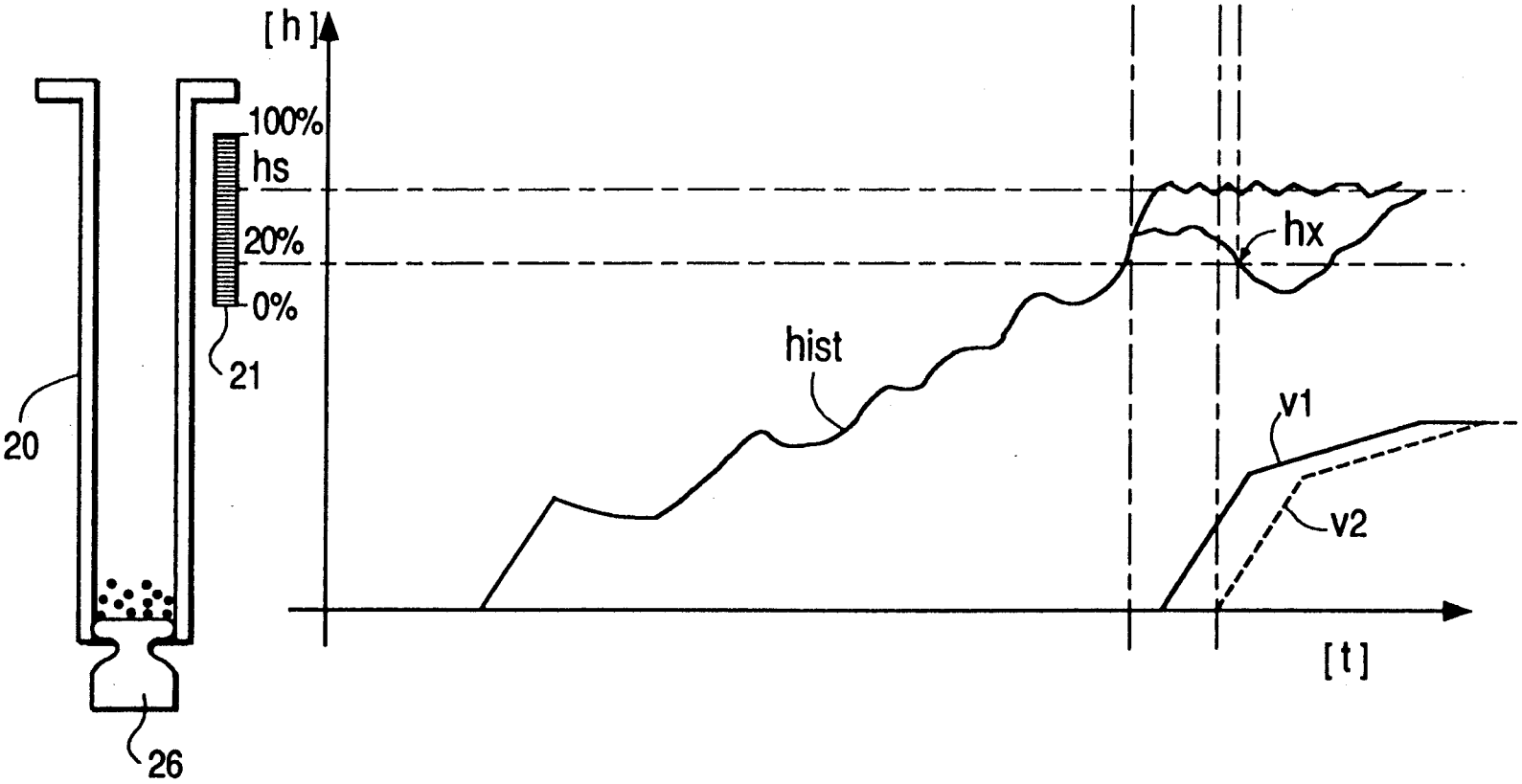
FIG. 3 depicts the level of the molten metal within the casting mold with respect to time.

As shown in FIGS. 2 and 3, a mold filling mode of the program-controlled casting process begins such that the stopper 15 is completely opened for a short period to a position P2, and thus the first molten metal flows into the mold 20. Prior to the lapse of a time interval $t_2$, a first shut-movement to a closing position P2' starts, in which it has been shown in practice that the position P2' is reduced by a certain amount relative to closing position P1. The opening of the stopper 15 to the position P2 and the closing of the same to the position P2' constitute a stopper stroke $S_2$. The stopper position P2' is predetermined using the computer 30. The stopper 15 is then moved up by a stroke $s_3$ as the following opening stroke $S_3$ after a time interval $t_2'$, the stroke $s_3$ starting from the effective closing position P2' adaptively. The program-controlled casting process continues then at time intervals $t_3$, $t_3'$, $t_4$, $t_4'$, $t_5$ and $t_5'$ to carry out the assigned opening strokes $s_3$, $s_4$, and $s_5$ corresponding to the positions P3 to P5. The strokes $s_3$, $s_4$ and $s_5$ of the controlled open/shut movements are reduced until they approach the average opening stroke $s_7$ stored in computer 30 as an empirical or calculated value. The average opening position P7 corresponds to a predetermined average position of the stopper during the regulated discharge of the molten metal when continuous casting is being carried out. For opening stroke $s_6$ at the corresponding time interval $t_6$, a more open position P6 is once again provided, and following the closing of the stopper during the time interval $t_6'$, the stopper is opened by a stroke $s_7$. As soon as the level h of the molten metal in the mold 20 reaches the measuring range of data transmitter 21, the program-controlled process of initially filling the mold 20 is terminated by the computer 30. The computer 30 then enters an automatic level control mode, in which a desired level within the mold 20 is regulated, for example, to be maintained at 80% of the sensor 21 measurement range using a PID (proportional-integral-derivative) controller. The range of measurement is usually only effected in the upper portion of the mold 20, and the transition from the mold filling mode to the automatic level control mode may take place as soon as the level of the molten metal reaches the measurement range of the sensor 21. In the automatic level control mode, when there are deviations from the desired level $h_s$, the controller drives the stopper 15, by means of controller 36 and the drive 17, to increase or decrease the molten metal discharge rate into the mold 20. The drive 17 includes, for example, a piston/cylinder unit. A position sensor 19 and a measurement value unit 37 deliver a feedback signal to computer 30 denoting the actual value of the drive position. A subordinate position controller in the computer 30 ensures the targeted desired position of the drive 17 and thus the stopper 15.

As those skilled in the art will appreciate, the above-mentioned automatic level control mode of the computer 30 can be readily carried out according to known processes.

Opening and closing strokes $s_2$ to sn and the opening and closing times $t_2$ to tn for carrying out the mold filling mode are stored in advance as parameters in computer 30. These parameters are designed specifically for the respective continuous casting machine based on experience and experimental trial and error.

Furthermore, for the casting process of FIG. 2, a number of open/shut movements are preprogrammed in the computer 30 so that if after the sixth open movement the actual molten metal level is still not within the sensor 21 measurement range, other program-controlled open/shut movements would ensue until the level reaches the sensor 21 measurement range so that the level can be regulated by the automatic level control mode.

FIG. 3 also depicts the movement of the starting head 26 by way of a speed curve $v_1$. The start-time period takes place approximately upon reaching the desired level $h_s$. Furthermore, the mold 20 fills in accordance with the illustrated actual molten metal level curve $h_{ist}$.

As an alternative to the above-described manner of terminating the mold filling mode of the casting process, after opening of the stopper 15 into position P7, and upon reaching the sensor 21 range of measurement, the stopper can once again be moved into the closing position as shown by the dashed curve of FIG. 2. Upon expiration of a time interval $t_7'$, the starting head 26 is withdrawn in accordance with an extraction speed curve $v_2$ of FIG. 3. As soon as the level $h_x$ drops below the 20% point of the sensor 21 measuring range, the stopper is opened, preferably in several substages, by an opening stroke $s_7$ and then the level controller of the computer 30 regulates the desired level $h_s$ according to the automatic level control mode. This intentional delay in withdrawing the starting head 26 provides a measure for further assuring that the molten metal in the mold has sufficiently hardened.

Figure 4:
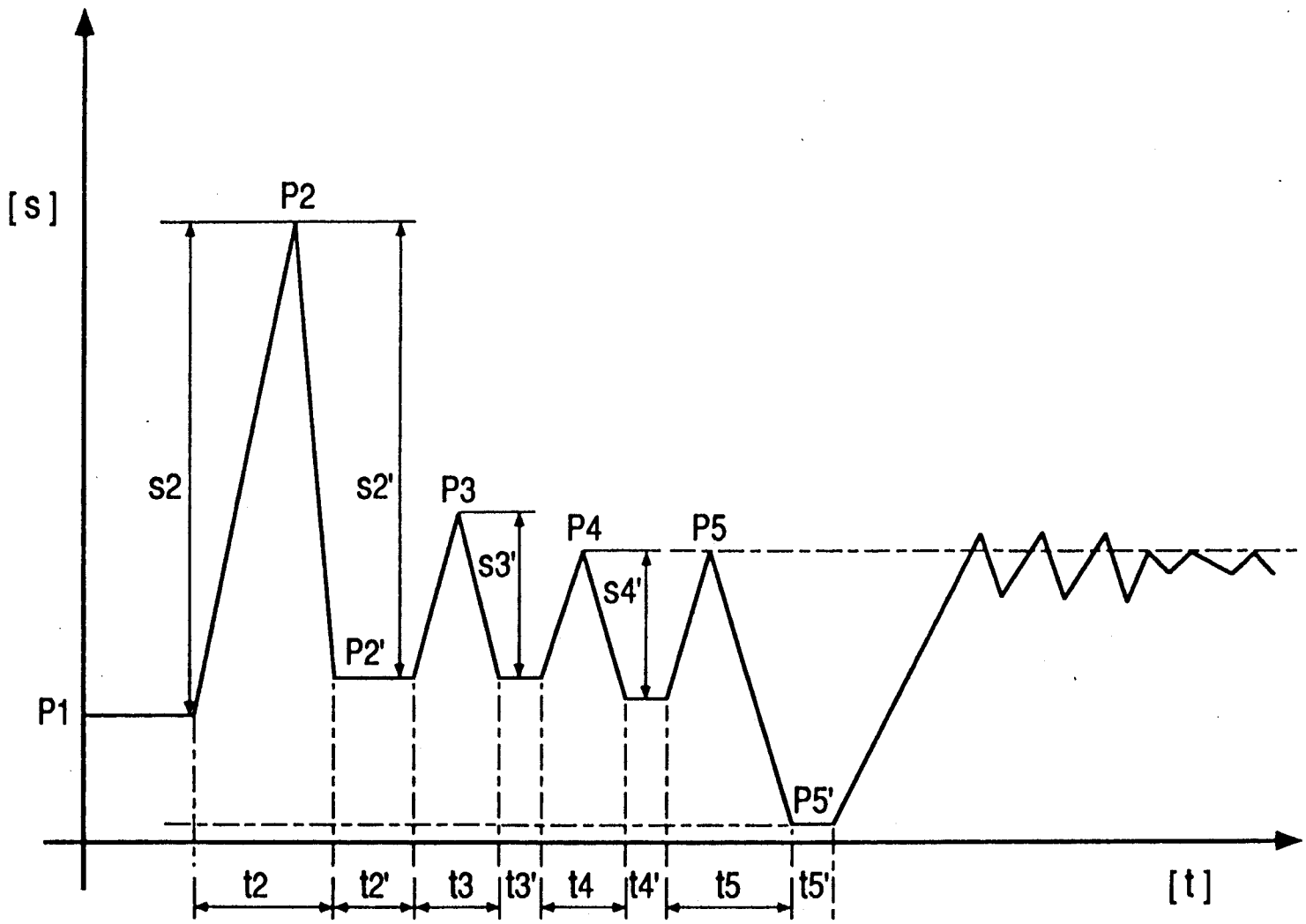
FIG. 4 depicts a variation of the casting process of the present invention.

FIG. 4 depicts the casting process according to the present invention as a path/time diagram. The pouring stopper 15 is initially moved into the complete opening position P2 by an opening stroke $s_2$ and then moved in the closing direction to a throttled position P2' by the closing stroke $s_2'$. After opening into positions P3 and P4 of reduced opening strokes, the stopper is respectively moved into throttled or not completely closed positions $s_3'$ or $s_4'$. Corresponding time intervals $t_2$, $t_2'$, $t_3$, $t_3'$, $t_4$, $t_4'$ are assigned to these open/shut movements. During time interval $t_5$, the stopper is opened into position P5 and then moved into a completely closed position P5' where it remains during time interval $t_5'$. Upon reopening of the stopper, the controller of the computer 30 assumes the continuous casting process according to the automatic level control mode and brings the level of the molten metal in the mold to the desired level $h_s$. The process for automatic casting according to FIG. 4 makes it clear that the process of the present invention can be readily adapted to machine-specific requirements in that various filling processes can be achieved.

The invention is not limited, of course, to the casting processes of the above embodiments. Rather, as already stated, the process can be adapted to continuous casting machines having different requirements, and also for casting of different steel grades, by changing the prestored parameters.

The invention is also not limited to a conventional stopper end, and instead can be applied just as well to known stopper-like systems, such as disclosed in the published patent application (WO 88/04209). In this flow control device, the stopper exhibits at its bottom end a cylindrical cone, which projects into the discharge opening of the vessel and forms a seal with the discharge sleeve. The cone has at its circumference at least one radial inlet opening and an elongated opening extending from this inlet opening. As an additional seal, the stopper has a cone frustum-shaped shutoff surface located above the cone, which forms together with the face of the discharge sleeve an additional seal when the shutoff is closed. The shutoff is opened and shut in turn by vertical adjustment of the stopper.

I claim:

1. An automatic casting process of a continuous casting machine, the continuous casting machine including a metallurgical vessel having a discharge opening, a stopper for opening and closing to affect a flow rate of a molten metal from the discharge opening, and a control device for controlling the opening and closing of the stopper, said process comprising:

a mold filling mode of conducting plural stopper strokes in succession, each stopper stroke constituting an opening and closing of the stopper, to discharge the molten metal into a continuous casting mold having an extracting end sealed by a starting head;

wherein the opening and closing of the stopper of each stopper stroke is effected at predetermined time intervals and at predetermined stopper positions which are preprogrammed in the control device.

2. An automatic casting process as recited in claim 1, wherein a relative opening position of the stopper is at a maximum for each of at least one initial stopper stroke, and wherein the relative opening position of the stopper is decreased for subsequent stopper strokes as the level of the molten metal within the continuous casting mold increases.

3. An automatic casting process as recited in claim 2, wherein the relative position of the stopper for each stopper stroke approaches a predetermined continuous cast stopper position, the continuous cast stopper position corresponding to an average position of the stopper after the starting head is withdrawn from the extracting end during continuous casting.

4. An automatic casting process as recited in claim 1, further comprising:

monitoring the level of the molten metal within the continuous casting mold;

ceasing the step of conducting plural stopper strokes in succession according to the mold filling mode and withdrawing the starting head from the extracting end of the continuous casting mold when the level of the molten metal within the continuous casting mold reaches a predetermined level;

initiating a continuous casting mode of controlling the stopper position to maintain the predetermined level of molten metal within the continuous casting mold.

5. An automatic casting process as recited in claim 2, further comprising:

monitoring the level of the molten metal within the continuous casting mold;

ceasing the step of conducting plural stopper strokes in succession according to the mold filling mode and withdrawing the starting head from the extracting end of the continuous casting mold when the level of the molten metal within the continuous casting mold reaches a predetermined level;

initiating a continuous casting mode of controlling the stopper position to maintain the predetermined level of molten metal within the continuous casting mold.

6. An automatic casting process as recited in claim 3, further comprising:

monitoring the level of the molten metal within the continuous casting mold;

ceasing the step of conducting plural stopper strokes in succession according to the mold filling mode and withdrawing the starting head from the extracting end of the continuous casting mold when the level of the molten metal within the continuous casting mold reaches a predetermined level;

initiating a continuous casting mode of controlling the stopper position to maintain the predetermined level of molten metal within the continuous casting mold.

7. An automatic casting process as recited in claim 4, further comprising placing the stopper in a fully closed position for a predetermined time period prior to withdrawing the starting head from the extracting end of the continuous casting mold.

8. An automatic casting process as recited in claim 5, further comprising placing the stopper in a fully closed position for a predetermined time period prior to withdrawing the starting head from the extracting end of the continuous casting mold.

9. An automatic casting process as recited in claim 6, further comprising placing the stopper in a fully closed position for a predetermined time period prior to withdrawing the starting head from the extracting end of the continuous casting mold.

10. An automatic casting process as recited in claim 1, wherein upon each opening of the stopper during the mold filling mode the stopper is positioned in one of a fully open position and an open throttled position, and wherein upon each closing of the stopper during the mold filling mode the stopper is positioned in one of the fully closed position and a closed throttled position.

11. An automatic casting process as recited in claim 2, wherein upon each opening of the stopper during the mold filling mode the stopper is positioned in one of a fully open position and an open throttled position, and wherein upon each closing of the stopper during the mold filling mode the stopper is positioned in one of the fully closed position and a closed throttled position.

12. An automatic casting process as recited in claim 3, wherein upon each opening of the stopper during the mold filling mode the stopper is positioned in one of a fully open position and an open throttled position, and wherein upon each closing of the stopper during the mold filling mode the stopper is positioned in one of a fully closed position and a closed throttled position.

13. An automatic casting process as recited in claim 4, wherein upon each opening of the stopper during the mold filling mode the stopper is positioned in one of a fully open position and an open throttled position, and wherein upon each closing of the stopper during the mold filling mode the stopper is positioned in one of a fully closed position and a closed throttled position.

14. An automatic casting process as recited in claim 1, further comprising detecting an actual closing position of the stopper upon each closing of the stopper during the mold filling mode, wherein each opening of the stopper during the mold filling mode is carried out relative to the previously detected actual closing position of the stopper.

15. An automatic casting process as recited in claim 2, further comprising detecting an actual closing position of the stopper upon each closing of the stopper during the mold filling mode, wherein each opening of the stopper during the mold filling mode is carried out relative to the previously detected actual closing position of the stopper.

16. An automatic casting process as recited in claim 3, further comprising detecting an actual closing position of the stopper upon each closing of the stopper during the mold filling mode, wherein each opening of the stopper during the mold filling mode is carried out relative to the previously detected actual closing position of the stopper.

17. An automatic casting process as recited in claim 4, further comprising detecting an actual closing position of the stopper upon each closing of the stopper during the mold filling mode, wherein each opening of the stopper during the mold filling mode is carried out relative to the previously detected actual closing position of the stopper.

18. An automatic casting process as recited in claim 1, further comprising providing as the stopper a member having a cylindrical cone that forms a seal with the sides of and projects into the discharge opening of the metallurgical vessel, at least one radial opening on a circumference of the cylindrical cone, and an elongated opening extending from the radial opening.

19. An automatic casting process as recited in claim 4, further comprising providing as the stopper a member having a cylindrical cone that forms a seal with the sides of and projects into the discharge opening of the metallurgical vessel, at least one radial opening on a circumference of the cylindrical cone, and an elongated opening extending from the radial opening.

* * * * *